United States Patent [19]

Kuru et al.

[11] Patent Number: 4,833,506

[45] Date of Patent: May 23, 1989

[54] METHOD AND APPARATUS FOR CONTROLLING TONER DENSITY OF COPYING DEVICE

[75] Inventors: Hiroshi Kuru; Tomio Arai, both of Hachioji, Japan

[73] Assignee: Konishiroku Photo Industry Co., Ltd., Tokyo, Japan

[21] Appl. No.: 54,314

[22] Filed: May 26, 1987

[30] Foreign Application Priority Data

May 30, 1986 [JP] Japan ..... 61-127003
Feb. 24, 1987 [JP] Japan ..... 62-39094
Feb. 24, 1987 [JP] Japan ..... 62-39095

[51] Int. Cl.[4] ..... G03G 15/08

[52] U.S. Cl. ..... 355/208; 355/246; 118/663, 668; 222/DIG. 1

[58] Field of Search ..... 355/3 DD, 3 R, 140, 355/14 R, 3 SH, 14 SH; 118/689, 665, 668, 663; 222/DIG. 1

[56] References Cited

U.S. PATENT DOCUMENTS 4,365,889 12/1982 Silverberg ..... 355/14 SH
4,416,535 11/1983 Tottori ..... 355/14 D
4,462,680 7/1984 Ikeda ..... 355/14 D
4,466,731 8/1984 Champion et al. ..... 355/14 D
4,468,112 8/1984 Suzuki et al. ..... 355/14 D
4,502,778 3/1985 Dodge et al. ..... 355/14 D X
4,506,973 3/1985 Ernst ..... 222/DIG. 1
4,519,695 5/1985 Murai et al. ..... 355/14 R

*Primary Examiner*—A. C. Prescott
*Attorney, Agent, or Firm*—Frishauf, Holtz, Goodman & Woodward

[57] ABSTRACT

A toner density control method and apparatus of a copying device for copying continuously from a plurality of documents onto recording sheets optically detect the density of a patch image of a reference density plate formed on the surface of a photosensitive drum of the copying device so as to control the toner density. The patch image is formed prior to formation of an image of a first one of a plurality of the documents, the density of the patch image is detected, and a toner replenishment amount during a copying operation of the plurality of documents is maintained constant on the basis of the detected density.

9 Claims, 5 Drawing Sheets

METHOD AND APPARATUS FOR CONTROLLING TONER DENSITY OF COPYING DEVICE

FIELD OF THE INVENTION

The present invention relates to a method and apparatus for controlling a toner density so as to maintain the density of a copied image constant in an electrophotographic copying device.

BACKGROUND OF THE INVENTION

In a copying device using a binary developing agent, the density of an image to be copied is greatly affected by the amount of toner contained in a developing unit. Therefore, in order to maintain an image density constant in a proper state, toner must be replenished immediately after its consumption in the developing unit. For this purpose, a toner replenishing unit is directly coupled to the developing unit An operation of the toner replenishing unit is controlled by a toner density control unit consisting of a sensor for detecting short supply of toner in the developing unit and a control section for receiving a signal from the sensor. On the other hand, means for detecting short supply of toner are as follows.

First, a ratio of a toner component in the developing agent is directly measured to detect short supply of toner. In this first method, the toner replenishing unit is activated by the signal from the control section when the ratio of the toner component with respect to a carrier in the developing unit is decreased below a specified value. Second, a latent image of a reference density plate is formed on an image carrier (photosensitive body) to indirectly detect short supply of toner in accordance with a density measurement result of an image (to be referred to as a patch image hereinafter) after development. In this second method, image processing of the patch image having a reference density is performed prior to image processing of a document, and the toner replenishing unit is activated when a measured density of the patch image is lower than a specified density.

However, in the former method, although the toner density can be maintained constant, the image density is not always maintained constant with respect to a change and the like in the latent image formed on the photosensitive body.

On the other hand, in the latter method, although the image density can be advantageously maintained constant, an image of the above reference density plate must be formed prior to formation of each document image. Therefore, this method cannot be applied to a copying device using a document feed unit such as a Recirculating Document Feeder (to be referred to as an RDF hereinafter) which sequentially feeds a large number of documents from a document table to an exposure unit to perform exposure and development, and returns them to the document table again.

That is, when an RDF is used, a document table and an exposure optical system of the copying device are fixed, and documents are continuously fed one by one from the lowermost one to the exposure unit of the document table by a conveyor belt of the RDF, thereby performing the image processing at a high speed, and thereafter the document is returned to its original position and stacked onto the remaining documents, so that the documents are recirculated. On the other hand, in a conventional copying device wherein a document is fixed to perform a copying operation, it is well known that an electrostatic latent image of the above patch image is obtained by adhering the reference density plate of a constant density at a position adjacent to a portion on which the document is placed, exposing the reference density plate similarly to exposure of the document, and forming a latent image of the reference plate on the photosensitive body.

Therefore, in the copying device including the RDF, wherein an exposure optical system is fixed and documents are continuously fed, as it is not possible to form the latent image of the reference density plate on the photosensitive body by scanning the reference density plate, only charging is performed onto the photosensitive body before the document is fed, and unnecessary portions are discharged by a discharging lamp, thereby forming the latent image corresponding to the reference density plate without using the plate. In this method, since a latent image for an image of the reference density plate is formed by a charging effect and turn-on of the discharging lamp during this image formation process, an additional process must be provided to turn off an exposure lamp. Therefore, when a plurality of documents are to be sequentially fed and exposed, a process must be provided to turn off the exposure lamp and to turn it on again every time a document is fed and exposed. As a result, an image processing speed of a document is largely decreased and a merit of using the RDF is lost.

FIG. 1 shows an example of a conventional density control circuit using a reference density plate.

In FIG. 1, reference numeral 1 denotes a toner density sensor. An image of the reference density plate, provided beforehand at the leading end of a platen glass on which a document is placed, is formed on a photosensitive drum, and its developed image is detected by the toner density sensor 1. The toner density sensor 1 is constituted by a photocoupler consisting of an LED 1*a* as a light-emitting element and a phototransistor 1*b* as a light-receiving element. Reference numerals VR1 and VR2 denote variable resistors for adjusting a current flowing through the LED 1*a;* Q1 and Q2, transistors for adjusting a voltage across the variable resistor VR2; Q3, a transistor for amplifying an output from the phototransistor 1*b;* R1, a base bias resistor of the transistor Q2; R2 and R3, resistors for converting an output current from the transistor Q3 into a voltage; and TH, a thermistor for compensating for temperature changes.

In this circuit, under the condition that a current flowing through the LED 1*a* is constant (an emitted light amount is constant), if the toner density of a portion to be detected is high, the amount of light reflected at this portion is small, so that the output current from the phototransistor 1*b* is decreased to reduce the voltage at an output terminal F. On the contrary, if the toner density is low, the voltage is increased.

An A/D converter 2 is connected to the output terminal F so as to convert a detection signal from the sensor 1 into a digital value with a necessary number of bits. The resultant digital value is compared with a reference value in an operation unit 3, and toner is replenished if necessary in accordance with a comparison result. This control is repeated every time a copying operation of one sheet is performed so that the toner density is always maintained constant.

The sensor 1 is also used to detect that a transfer sheet is wound around the photosensitive drum. That is, utilizing the fact that a reflectivity of the transfer sheet is higher than that of the photosensitive drum, a point at which the output from the sensor 1 becomes higher than a normal output when the transfer sheet is wound around the photosensitive drum is detected, thereby stopping the copying operation.

However, as the density of a copy image is increased, the density of a primary image of a toner control patch is also increased. Therefore, the light-emitting element is used at a low sensitivity, so that proper control cannot be performed depending on variations in sensitivity of the light-emitting element. In order to prevent this, a light amount of the light-emitting element may be increased. However, since the light-emitting element is also used as a sensor for detecting winding, an increase in the light amount is naturally limited.

SUMMARY OF THE INVENTION

It is a first object of the present invention to provide a toner density control method capable of effectively replenishing toner on the basis of density detection of a patch image without decreasing a copying speed even when an RDF is used.

It is a second object of the present invention to provide a toner density control apparatus in which a toner density sensor is also used as a winding sensor even when a high-density image is to be copied.

DETAILED DESCRIPTION OF THE PREFERRED EMBODIMENTS

Figure 2:
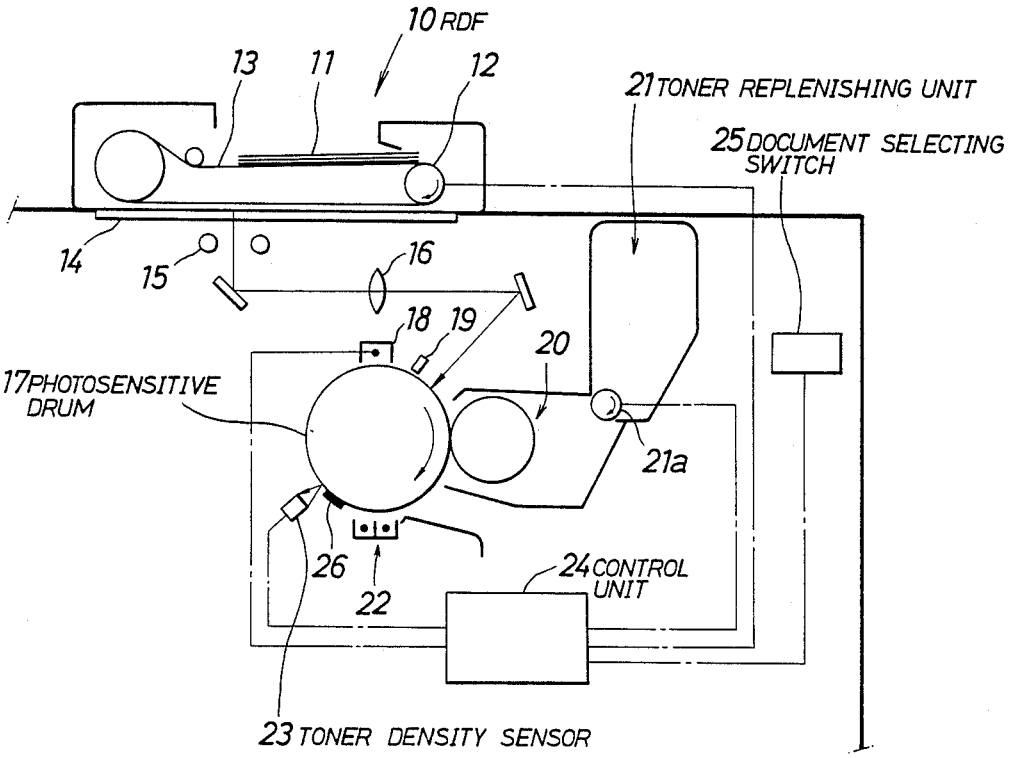
FIG. 2 is a schematic diagram of an embodiment of an electrophotographic copying device adopting a toner density control apparatus according to the present invention.
Figure 3:
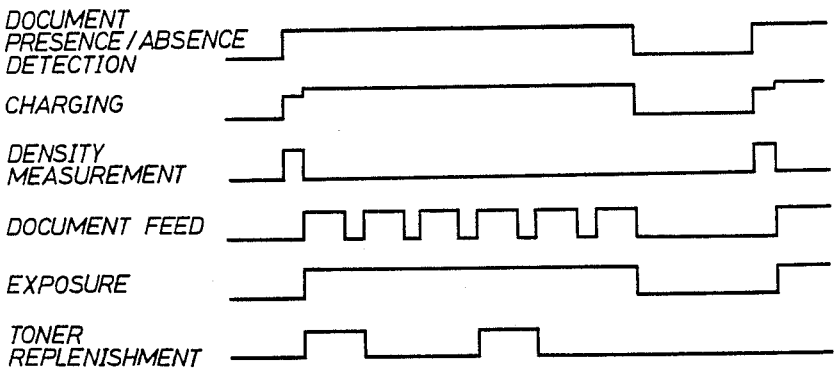
FIG. 3 is a timing chart of an operation of the electrophotographic copying device shown in FIG. 2.
Figure 4:
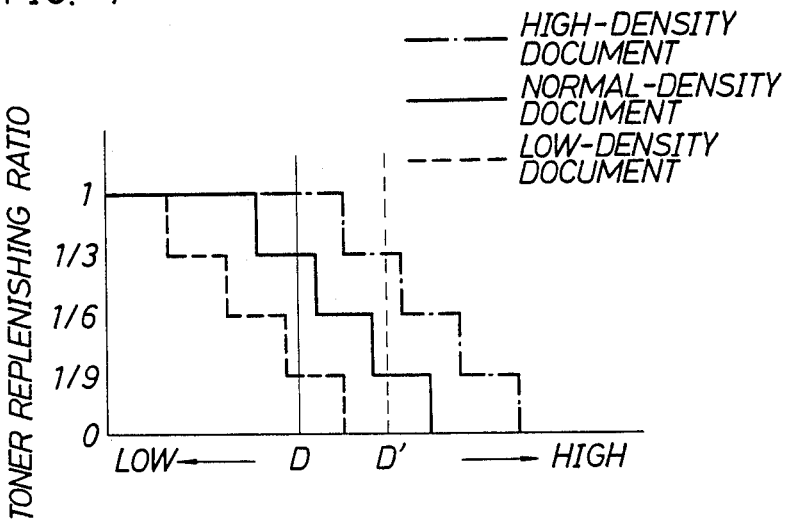
FIG. 4 is a graph showing toner density control of the electrophotographic copying device shown in FIG. 2.

FIGS. 2 to 4 show an embodiment of the present invention.

FIG. 2 is a schematic view showing an arrangement of a copying device including a toner density control apparatus according to the present invention.

In FIG. 2, reference numeral 10 denotes an RDF placed on an upper portion of the copying device. Documents 11 stacked on a document tray are sequentially conveyed from the lowermost one to a document table 14 on the upper surface of the copying device by a conveyor belt 13 which is circularly moved upon rotation of a document feed roller 12.

A slit-like exposure unit formed by an exposure lamp 15 of a fixed exposure optical system is disposed on the document table 14. When the documents 11 pass through this unit, document surfaces are continuously projected on the surface of a synchronously rotating photosensitive drum 17 through a projecting lens 16. In this case, since the surface of the photosensitive drum 17 is subjected beforehand to charging by a charging electrode 18 and discharging at its non-image area by a discharging lamp 19, electrostatic latent images only of document images are formed. These electrostatic latent images are sequentially developed into toner images in a developing unit 20 and then transferred onto recording sheets by a transfer electrode 22.

In addition, a toner density sensor 23 is disposed on the surface of the photosensitive drum 17 on the downstream side of the transfer electrode 22 to measure the density of a patch image 26 formed on the surface of the photosensitive drum 17 and to supply this density information to an electrical control unit 24.

An optical sensor including an LED as a light-emitting element and a phototransistor as a light-receiving element is suitable for detecting the toner density. However, the toner density can be electrically detected by a surface potentiometer.

In addition, a level of a charging potential by the charging electrode 18 is fed back to the electrical control unit 24 as a factor relating to the density of the patch image 26 on the surface of the photosensitive drum 17. Furthermore, information relating to the document surface density of each document 11 is input by a document selecting switch 25 which is manually operated from outside the apparatus.

The document selecting switch 25 is switched in accordance with the density over the entire surface of the document 11 to one of 3 steps, i.e., a step for a high-density document with a large toner consumption amount such as a catalog document, a step for a normal-density document, and a step for a low-density document with a small toner consumption amount such as a document written in pencil. In accordance with a signal from the document selecting switch 25, one of 3 types of step-like programs shown in FIG. 4 which are stored in the control unit 24 is selected, and a toner replenishment ratio is determined by the density information from the toner density sensor 23. The toner replenishment ratio can be defined as an actual replenishment quantity to a maximum replenishable quantity of a toner replenishing device and is determined by a toner replenishing time and a quantity of toner as replenished one time.

Toner density control in the above copying device will be described below with reference to FIGS. 3 and 4. Note that in FIG. 3, a delay relationship caused by a positional relationship between the means, the sensor, and the like disposed on the surface of the photosensitive drum is neglected.

Upon depression of a copy button, document detection on the document tray is performed. When a document 11 is detected, rotation of the photosensitive drum 17 and operation of the developing unit 20 are started first. Then, a voltage is applied by the charging electrode 18 and the discharging lamp 19 is partially turned on to form a reference density latent image on the surface of the photosensitive drum 17. Thereafter, this latent image is developed to form a patch image. A charging potential for forming the reference density latent image is set at a level suitable for toner density determination and hence need not be identical to a charging condition during a continuous copying operation. Note that during this operation, the exposure lamp 15 is naturally not turned on.

Subsequently, a toner density of the patch image is measured by the toner density sensor 23, converted into an electrical signal, and then supplied to the control unit 24. Thereafter, the electrical signal is converted into a value of gray level of the image density upon comparison with an electrical signal serving as a standard and predetermined in accordance with a relationship with respect to the charging condition of the patch image. It is a matter of course that the electrical signal value can be directly used.

When the image density represents, e.g., a value of density D shown in FIG. 4 as a result of the above processing and the document selecting switch 25 corresponds to the normal-density document, the control unit 24 rotates a toner replenishing roller 21*a* of the toner replenishing unit 21 connected to the developing unit 20 with a toner replenishment ratio of $\frac{1}{3}$, thereby replenishing toner to the developing unit 20.

Therefore, during the copying operation continuously performed by rotation of the document feed roller 12 and turn-on of the exposure lamp 15, when toner density measurement of the patch image is ended, the toner replenishing roller 21*a* is rotated to replenish the toner in accordance with a signal supplied from the control unit 24 only for a time corresponding to $\frac{1}{3}$ of a copying time, i.e., only while the image processing is performed for 1 out of 3 documents.

On the other hand, when the image density measured by the density sensor 23 is high enough to represent, e.g., a position D′ in FIG. 4, the toner replenishment ratio can be decreased, so that the toner is replenished for a time corresponding to 1/9 of the copying operation time.

A description has been made with reference to the case wherein the document selecting switch 25 corresponds to the normal-density document. On the other hand, assume that the document selecting switch 25 corresponds to a low-density document. When the measured image density of the reference density plate represents position D, the toner replenishment ratio can be decreased, and the toner is replenished only for a time corresponding to 1/9 of the copying operation time. In addition, in the case of high density wherein the measured density of the patch image represents the position D′, the toner is not replenished.

In the above embodiment, the document selecting switch 25 is switched among 3 steps, but the number of steps is not limited to 3. In addition, a description has been made with reference to the case wherein a program directly corresponding to the switched step is stored in the control unit 24. However, when a continuous copying operation is performed with respect to various recording sheet sizes, the control unit 24 may prestore programs determined by combinations of the switched steps and recording sheet sizes, so that the toner replenishment ratio is determined in accordance with the program and the measured density of the reference density plate.

Furthermore, in the above description, the document selecting switch 25 is operated manually by an operator. However, a document density over the entire surface of the document may be automatically detected by a detecting means provided near the exposure unit for the first document or a plurality of subsequent documents, so that the document selecting switch 25 is switched to one of a plurality of document selecting steps in accordance with this density information. This is achieved by use of a conventional automatic document density setting device.

Figure 5:
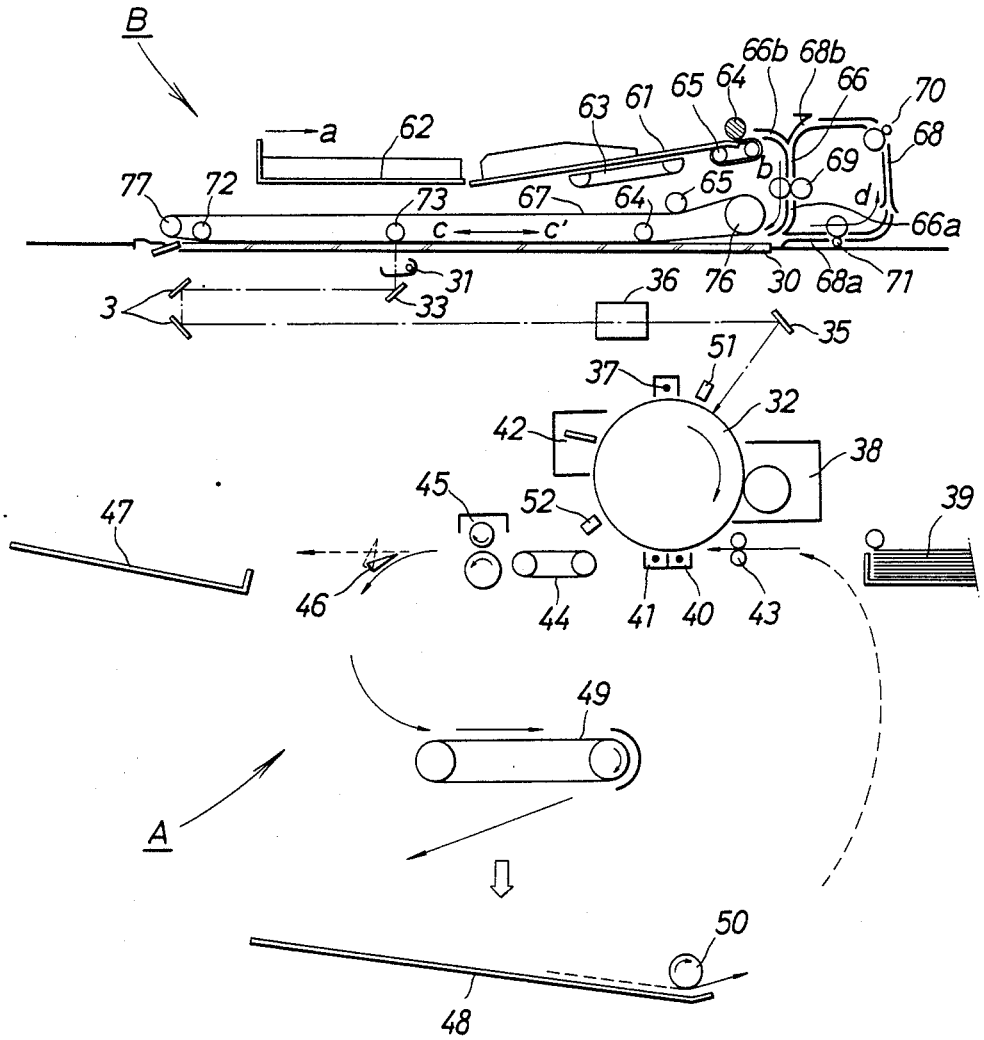
FIG. 5 is a schematic view of a second embodiment of an electrophotographic copying device adopting the toner density control apparatus according to the present invention.

FIG. 5 shows the second embodiment of the present invention.

In this embodiment, a two-side document feed mechanism B is set on a two-side copying mechanism A for copying document images on both the front and rear sides of a recording sheet.

The two-side copying mechanism A has a light source 31 for exposing the document on the lower surface of a document table 30 on which the document is set, and an optical system consisting of mirrors 33 to 35 and a lens 36 for guiding the light emitted by the light source 31 and reflected by the document to a photosensitive drum 32. The photosensitive drum 32 is surrounded by a charging electrode 37 for charging the photosensitive drum 32, a developing unit 38 for developing by the toner a latent image formed on the photosensitive drum 32 which is exposed by the optical system and has this latent image formed thereon, a transfer electrode 40 for transferring the toner image on a transfer sheet fed from a feed unit 39, a separation electrode 41 for separating the transfer sheet from the photosensitive drum 32, and a cleaning unit 42 for removing the toner remaining on the surface of the photosensitive drum 32 to clean it. Reference numeral 43 denotes registration rollers for feeding out the transfer sheet toward the photosensitive drum 32 at a predetermined timing; 44, a conveyor belt; 45, a thermal fixing unit; 46, a two-side selecting guide for selecting a direction for feeding the fixed transfer sheet to be, a direction of an exhaust tray 47 or a direction of an intermediate tray 48 for reversing the sheet; 49, a transfer sheet reversing belt; 50, a feedout roller from the intermediate tray; 51, a discharging lamp for removing electrical charges at unnecessary portions on the surface of the photosensitive drum 32 charged by the charging electrode 37; and 52, a density sensor consisting of a reflecting photocoupler for detecting the density of the patch image.

On the other hand, the two-side document feed mechanism B has a stationary document tray 61 for setting a two-side document, and a movable document tray 62. A semi-circular roller convey unit 63 is disposed on the lower surface of the stationary document tray 61, and a stationary roller 64 and a feedout belt 65 are disposed at the distal end portion thereof. Reference numeral 66 denotes a document feedout guide; 67, a document conveyor belt for moving a document onto the upper surface of the document table 30; and 68, a document reversing guide constituting a document reversing unit for reversing the front and rear sides of the document. An entrance 68*a* of the document reversing guide 68 is disposed near an exit 66*a* of the document feedout guide 66, and an exit 68*b* of the document reversing guide 68 is disposed near an entrance 66*b* of the document feedout guide 66. Reference numerals 69 to 71 denote conveyor rollers; 72 to 75, belt tension rollers; and 76 and 77, driving and driven rollers, respectively.

In this copying device system, a necessary number of documents are placed on the movable document tray 62, and the movable document tray 62 is pushed along a direction represented by an arrow a, so that the distal end of the document stack is sandwiched between the stationary roller 64 and the feedout belt 65. Thereafter, when a copy button is operated, the lowermost one of the stacked documents is fed out by rotation of the semi-circular roller convey unit 63 and the feedout belt 65, fed along a direction represented by an arrow b by the feed roller 59, and conveyed on the document table 30 along a direction represented by an arrow a at a predetermined speed by the document conveyor 67.

At this time, the light source 31 is fixed at a predetermined position, and the document is moved on the upper surface of the light source 31 at a predetermined speed. Therefore, its exposure light is guided by the optical system to the photosensitive drum 32 which rotates in synchronism with movement of the document, so that a latent image of a document image is formed on the photosensitive drum 32. A transfer sheet set in the feed unit 39 is fed therefrom so as to align with the distal end of the image on the photosensitive drum 32. A toner image is transferred onto the transfer sheet by the transfer electrode 40, the transfer sheet is separated from the photosensitive drum 32, and the toner image is fixed on the transfer sheet by the thermal fixing unit 45. When the selecting guide 46 is located at a position represented by a solid line, the transfer sheet is exhausted onto the exhaust tray 47. The above description has been made with reference to a one-side document copying operation.

In the case of copying the rear side of the same document, the selecting guide 46 is switched to be located at a position represented by a broken line, so that the transfer sheet on which the image on the front side of the document is transferred is fed to the reversing belt 49. The transfer sheet is reversed by the reversing belt 49, fed out from the intermediate tray 48, and then fed to the registration rollers 43 by the feedout roller 21.

On the other hand, the document is fed as follows. The document the front side of which is already copied in the manner described above reaches the left end of FIG. 5. Then, the document is fed along the opposite direction, i.e., a direction represented by an arrow c', and entered in the entrance 68*a* of the document reversing guide 68. Thereafter, the document is fed along a direction represented by an arrow d by the feed rollers 71 and 70, guided from the exit 68*b* to the document feedout guide 66, and fed along the direction represented by the arrow b as described above. Therefore, at this time, the front and rear sides of the document has been reversed. When the distal end of the document reaches the exit 66*a* of the guide 66, the document is fed along the direction represented by the arrow c by the document conveyor belt 67, and exposed on the document table 30 again. Then, latent image formation and development are performed as described above, and the rear side of the document is copied on the rear side of the transfer sheet having the copied front surface and waited at the registration rollers 43.

A method of performing exposure by moving a document while an optical system is fixed as described above is adopted when a document is to be copied at a high speed or when a high magnification is used. In either case, the density of toner subjected to development at the developing unit 38 must be accurately controlled.

Figure 6:
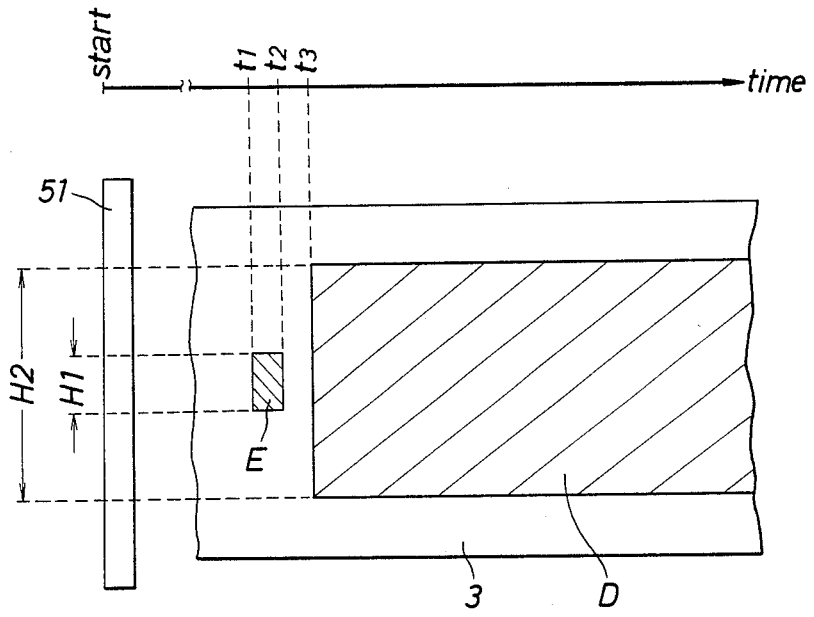
FIG. 6 is a view for explaining a toner density control operation of the electrophotographic copying device shown in FIG. 5.

As briefly described above, this toner density control is performed such that a portion H1 of the discharging lamp 51 is turned off and the other portion thereof is turned on between timings t1 and t2 before an image formation area D, thereby forming a pseudo patch image formation area E with remaining electrical charges on the surface of the photosensitive drum 32, as shown in FIG. 6. Then, toner is attracted thereon, and the toner density is detected by the density sensor 52. If the detection output is below a predetermined value, toner is replenished to the developing unit 38, thereby controlling the toner density. Note that the image formation area D in FIG. 6 is formed by turning off a portion H2 of the discharging lamp 51 and turning on the other portion from the timing t3 so that the illuminated portion is discharged.

However, when a plurality of documents are set on the document tray 61 of the two-side document feed mechanism B and are copied at the same time at a high speed, it is difficult to form a pseudo patch image for each copy.

Therefore, in this embodiment, the documents set on the document tray 61 are handled as one stack of documents and are sequentially fed and copied from the lowermost one, and a time interval from start of the operation to a timing at which all the stacked documents are copied is determined as one cycle. The density is detected once in a cycle before formation of the first copy, and the density in this cycle is controlled on the basis of this detection result.

That is, the pseudo patch image is formed prior to formation of the first copy image of one cycle, and a toner replenishment interval during the cycle is determined by the level of a density detection output of the pseudo patch image supplied from the density sensor 52, thereby controlling the toner density.

For example, the area E for the pseudo patch is formed by a photosensitive body surface potential of 600 V, and a relationship between a density detection voltage and the number of toner replenishment operations is predetermined such that when a detection voltage of a density of the toner attracted on the area E is 0.2 V or less (high density), toner replenishment is performed once for every 20 copies, when 0.20 to 0.25 V, for every 5 copies, and when 0.30 V or more (low density), for every 2 copies, thereby controlling the toner density. Note that the number of toner replenishment operations naturally changes when a toner replenishment amount or a toner consumption amount for one time is changed.

As described above, according to the present invention, when a plurality of copies are continuously formed, the toner density is detected only once before formation of the first copy, and the toner density is controlled in accordance with a detection result thereafter. Therefore, the pseudo patch image for controlling the toner density need not be formed for each copy, and the present invention can be applied to a high speed copying operation.

Figure 7:
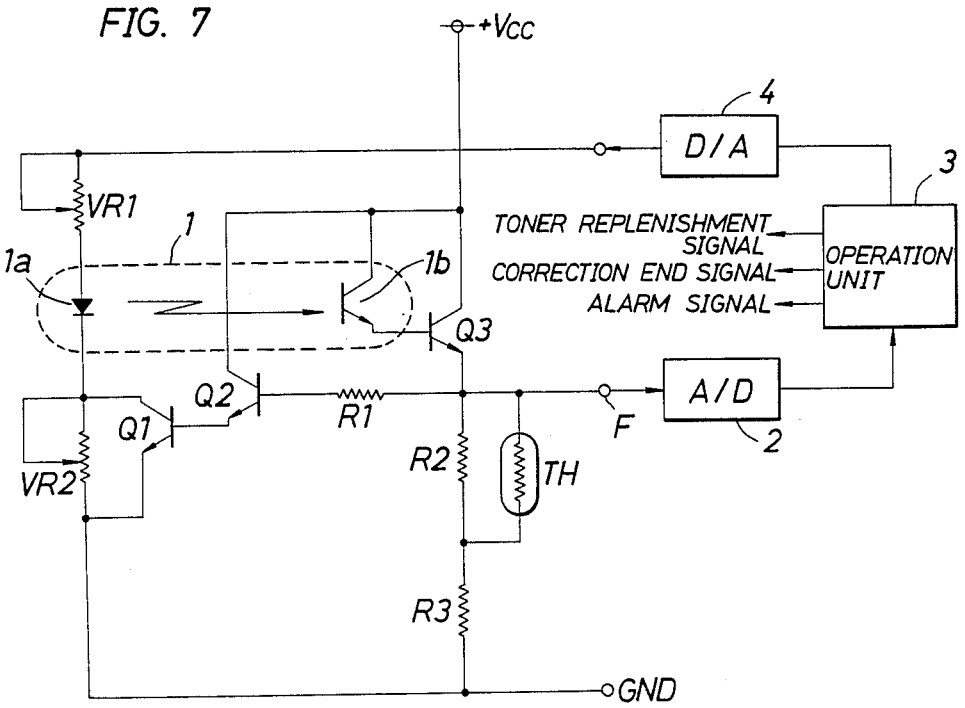
FIG. 7 is a circuit diagram of a third embodiment of a density control circuit of the toner density control apparatus according to the present invention.
Figure 8B:
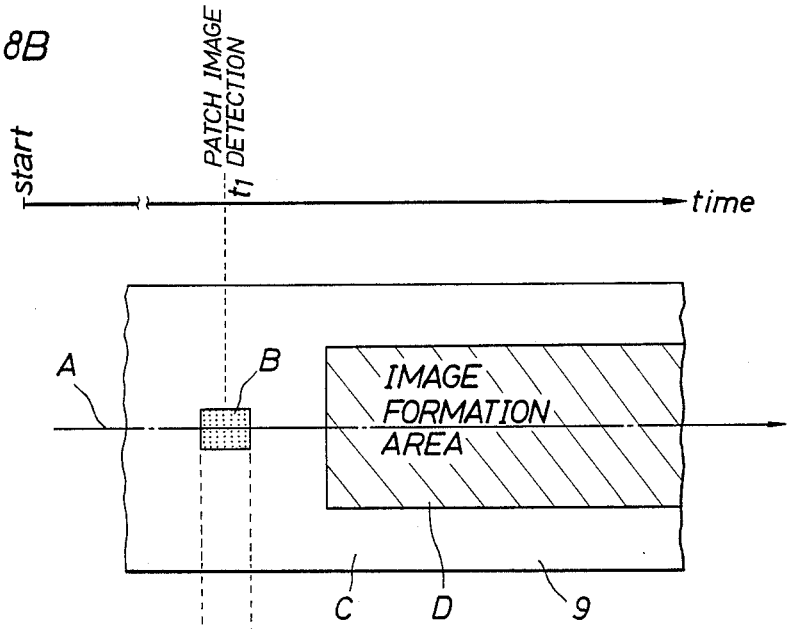
FIGS. 8A and 8B are views for explaining a toner density control operation of the density control circuit shown in FIG. 7.

FIGS. 7 and 8 show the third embodiment of the present invention.

Figure 1:
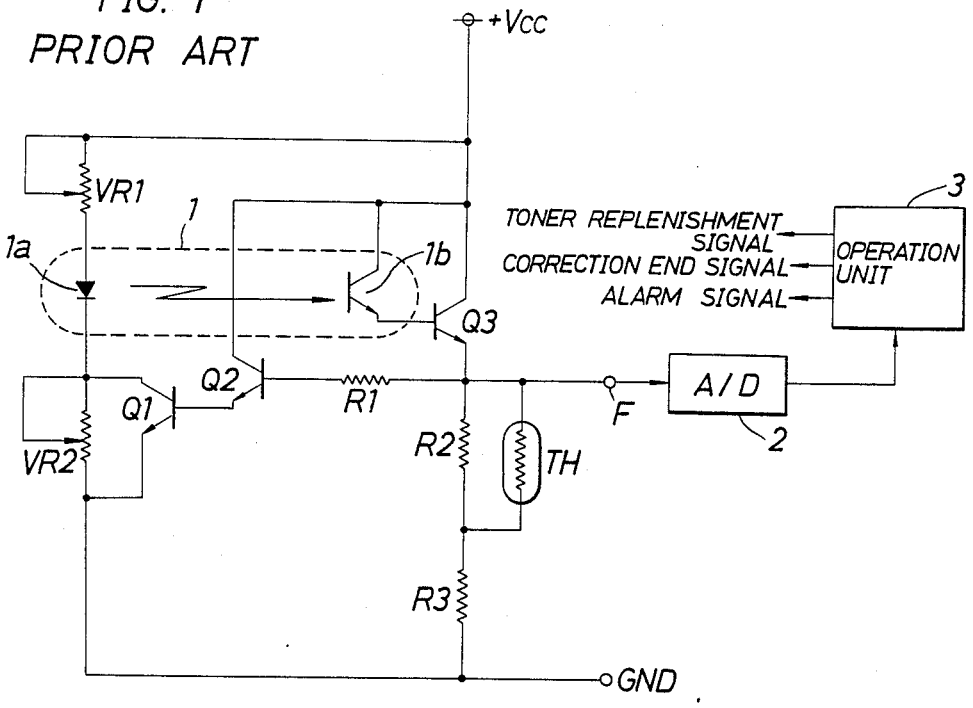
FIG. 1 PRIOR ART
FIG. 1 is a circuit diagram of an example of a conventional density control circuit using a reference density plate.

In FIGS. 7 and 8, the same parts as in FIG. 1 are denoted by the same reference numerals, and a detailed description thereof will be omitted.

In the third embodiment, an arrangement is such that a value calculated by the operation unit 3 is supplied to the D/A converter 4, and a power source voltage of the LED 1*a* of the sensor 1 is controlled in accordance with an output from the D/A converter 4. Note that the operation unit 3 outputs, in addition to the power source voltage data, a toner replenishment signal, a toner contamination compensation signal, a contamination compensation operation output end signal, a contamination limit alarm singal, and the like.

Figure 8A:
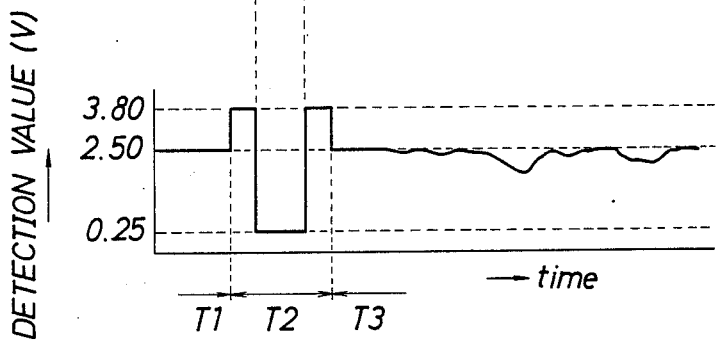

The sensor 1 moves with respect to the photosensitive drum such that its locus A passes through a patch image B, a non-image formation area C, and an image formation area D as shown in FIG. 8A.

In the third embodiment, the power source voltage of the LED 1*a* of the sensor 1 is so controlled as to obtain an output voltage having a characteristic as shown in FIG. 8A from an output terminal F on the locus of the sensor 1.

That is, in a timing interval T1 immediately before the patch image area B, a value by which a normal output voltage value of the output terminal F becomes 2.5 V is supplied as data for detecting sheet jamming caused by winding of the sheet to the D/A converter 4, thereby determining the power source voltage value of the LED 1*a*. In addition, in a timing interval T2 between immediately before and after the patch image area B, a value by which the normal output voltage becomes 3.8 V is supplied as toner density control data to the D/A converter 4, thereby determining the power source voltage value of the LED 1*a*. Furthermore, in a timing interval T3 thereafter, a value as the jamming detection data as in the timing interval T1 is supplied. That is, when the sensor 1 serves to detect jamming, a light amount is low, and when it serves to detect the patch image density, the light amount is high.

The toner density information is fetched at a timing t1 in the timing interval T2. The data fetched at this timing is compared with the reference density data. When the input density data is lower than the reference density data, the toner replenishment signal is output to drive the toner replenishing roller 21*a* of the toner replenishing unit 21 as shown in FIG. 2, thereby performing toner replenishment.

In addition, as for jamming detection, when the voltage value of the output terminal F becomes 3.5 V or more, the jamming alarm signal is output from the operation unit 3, and at the same time, the overall operation of the apparatus is stopped. Note that the detection data obtained in the timing interval T2 cannot be used as jamming detection.

Note that in the third embodiment, light amounts of the LED 1*a* are different from each other in the timing intervals T1 and T3 and in the timing interval T2 because of the program. However, a rotation angle position signal of the photosensitive drum 18 may be detected by hardware to switch the power source voltage value of the LED 1*a*.

As has been described above, according to the present invention, the light amount of the light-emitting element of the sensor can be switched, so that the light amount can be decreased during jamming detection and increased when the toner density information is to be fetched. Therefore, even when an image is controlled to have a high density, the single sensor can be used for both the toner density control and jamming detection without any trouble. The light-emitting element has been mentioned above, but can be used with a light-receiving element whose light receiving sensitivity is made changeable.

What we claim is:

1. In a copier having a device for automatically feeding a set of a plurality of originals to be photocopied sequentially in which a test patch image is established on a photosensitive surface of the copier for use in controlling toner density, a method comprising the steps of:

(a) cyclically feeding the set of originals with said device for effecting a continuous photocopying operation which provides a set of corresponding copies for each cycle of a plurality of cycles in which the set of originals is fed by said device to be photocopies, (b) forming said test patch image during the continuous photocopying operation only prior to formation of an image on said photosensitive surface of a first original in each of said plurality of cycles, (c) determining a density of the test patch image, (d) for each of said plurality of cycles providing a relationship between density of the test patch image and a rate of toner replenishment per predetermined number of copy pages output by the copier, and (e) maintaining toner in the copier during said continuous photocopying operation in accordance with said relationship and the determined test patch density.

2. A method according to claim 1 comprising varying the toner replenishment amount in accordance with a selected document density.

3. A method according to claim 1, wherein the test patch density is determined by optically detecting said density of said patch image by optically detecting a density of a patch image of a reference density plate formed on said photosensitive surface of said copying device.

4. Apparatus for maintaining toner density in a copier capable of feeding a set of a plurality of originals to be photocopied sequentially and in which a test patch image is established on a photosensitive surface of the copier for use in controlling toner density, comprising:

(a) means for cyclically automatically feeding the set of originals for effecting a continuous photocopying operation which provides a set of corresponding copies for each cycle of a plurality of cycles in which the set of originals is fed by said device to be photocopied, (b) means for forming said test patch image during the continuous photocopying operation only prior to formation of an image on said photosensitive surface of a first original in each of said plurality of cycles, (c) means for determining a density of the test patch image, (d) means for providing, for each of said plurality of cycles, a relationship between density of the test patch image and a rate of toner replenishment per predetermined number of copy pages output by the copier, and (e) means coupled to said providing means and said determining means for maintaining toner in the copier during said continuous photocopying operation in response to the relationship and the determined test patch density.

5. An apparatus according to claim 4, further comprising document density selecting means, and wherein said controlling means includes means for varying a value of the toner replenishment amount in accordance with a density of a document selected by said document density selecting means.

6. An apparatus according to claim 4, wherein said feeding means includes a recirculating document feeder device which includes means for continuously supplying a plurality of documents.

7. A toner density control apparatus of a copying device comprising:

a photocoupler comprising a light-emitting element, a light-receiving element disposed near a photosensitive surface, and means for providing an output signal based on the amount of light received by said light-receiving element;

toner replenishing means;

controlling means for controlling said toner replenishing means on the basis of an output signal from said photocoupler; and jam detecting means for detecting that a recording sheet is wound around the photosensitive surface on the basis of an output signal from said photocoupler; and wherein a light amount emitted by said light-emitting element during density detection of a path image is different from that emitted during jam detection.

8. An apparatus according to claim 7, wherein said light-receiving element is selectively changeable.

9. An apparatus according to claim 7, wherein said controlling means controls said toner replenishing means such that the toner replenishment amount is maintained substantially constant during a copying operation of as predetermined number of documents.

* * * * *